United States Patent [19]

Schmid

[11] 3,954,264

[45] May 4, 1976

[54] BOWLING PIN SWEEPER APPARATUS FOR AUTOMATIC BOWLING ALLEYS

[75] Inventor: August Schmid, Schwerzenbach, Switzerland

[73] Assignee: Patentverwertungs-und Finanzierungsgesellschaft Serania AG, Glarus, Switzerland

[22] Filed: Dec. 23, 1974

[21] Appl. No.: 535,698

[30] Foreign Application Priority Data

Dec. 27, 1973 Switzerland ..... 18134/73

[52] U.S. Cl. ..... 273/54 A

[51] Int. Cl.[2] ..... A63D 5/00

[58] Field of Search ..... 273/43 R, 43 A, 54 A, 273/53

[56] References Cited

UNITED STATES PATENTS

| | | | |
|---|---|---|---|
| 2,580,853 | 1/1952 | Sherman | 273/43 A |
| 2,657,929 | 11/1953 | Auchincloss et al. | 273/54 A |
| 2,980,424 | 4/1961 | Sanders et al. | 273/43 A |
| 3,233,901 | 2/1966 | Sandahl | 273/54 A |
| 3,790,167 | 2/1974 | Lenhart | 273/53 |

*Primary Examiner*—Richard C. Pinkham
*Assistant Examiner*—Harry G. Strappello
*Attorney, Agent, or Firm*—Flynn and Frishauf

[57] ABSTRACT

To provide for rapid drop of the bowling pin sweeper for removal of fallen bowling pins, without jamming of pins between the sweeper arm, an electromagnetic release such as a magnet operating a sear, triggered, for example, by movement of a bowling ball towards the pins releases the sweeper arm to drop, by its own weight (braked at the end of the fall by a dash pot) prior to initiation of sweeping operation, the remainder of the sweeping cycle being permitted to continue at normal, sweeping speed.

15 Claims, 5 Drawing Figures

26
E
7
8
16
II
9
1
19
17
18
20
21
23
24
6
22
15
5
4
2
C
10
11
14
3
A
12
13

Fig. 3
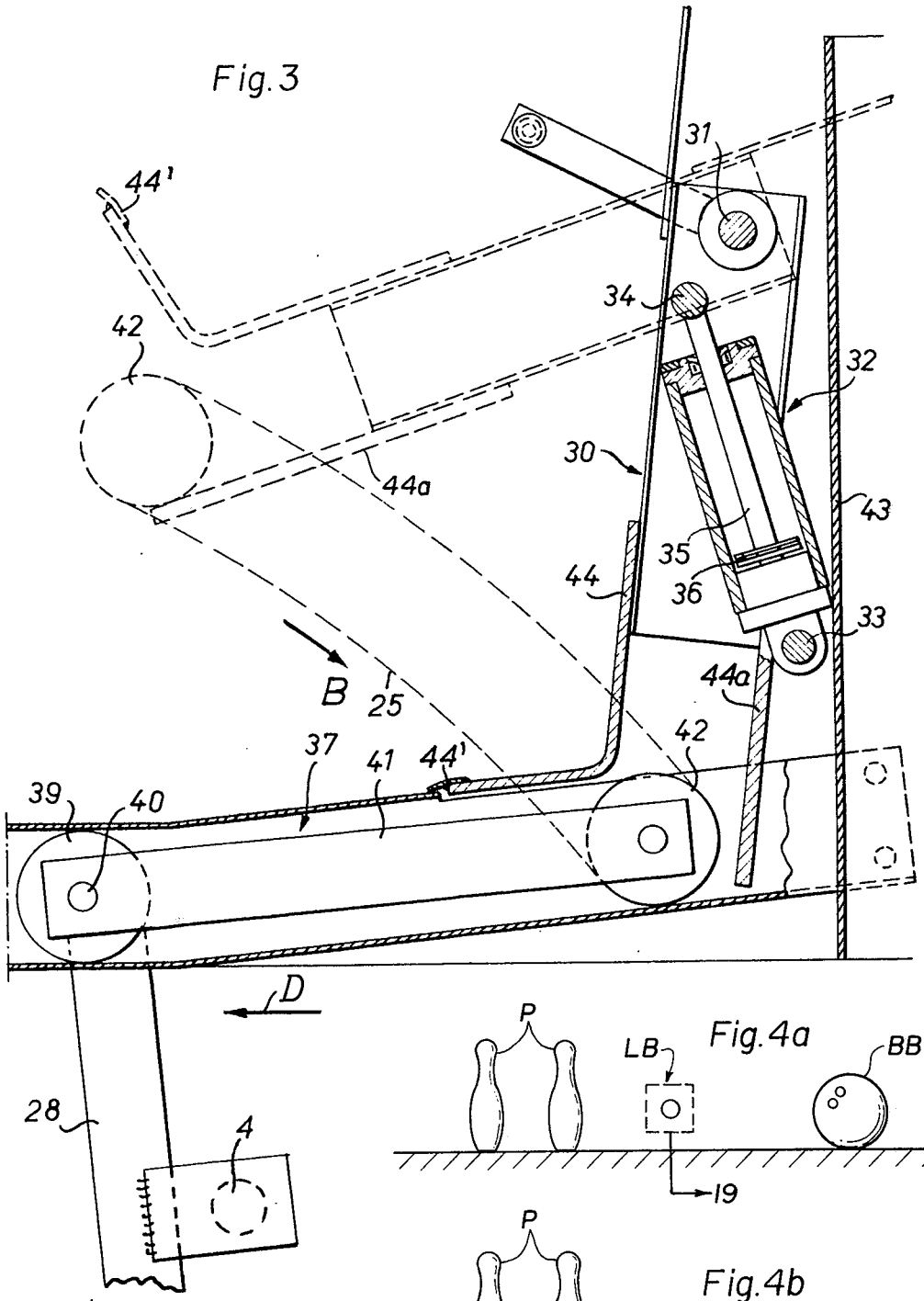
Fig. 4a
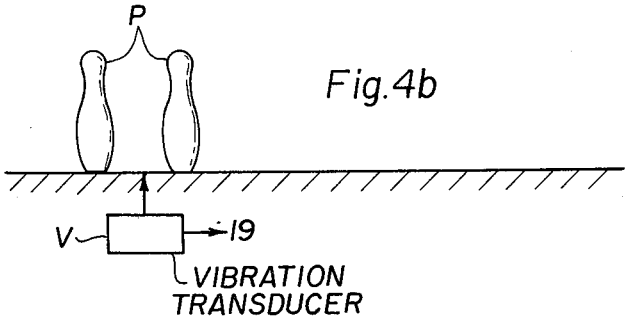
Fig. 4b

BOWLING PIN SWEEPER APPARATUS FOR AUTOMATIC BOWLING ALLEYS

Cross reference to related patents and applications: U.S. Pat. Nos. 3809398, 3809400, and 3810617.

The present invention relates to a sweeper mechanism to remove fallen and other bowling pins in an automatic bowling alley, and more particularly to the type of apparatus in which a sweeper bar is guided for essentially horizontal movement in guide tracks, the sweeper bar being supported by one or more sweeper arms. The bar-arm combination is lifted out of sweeping position, and upwardly at the forward end of the travel, so that the view and path from the player to the bowling pins is unobstructed when the sweeper is in inoperative position.

Automatically operating bowling pin sweeper mechanisms are subject to interference with their movement or other malfunction if bowling pins which have been thrown over by the bowling ball get trapped beneath the sweeper bar, or sweeper blade, as the sweeper arm with the bar or blade slowly descends towards the floor of the bowling alley to sweep the pins away.

It is an object of the present invention to provide a sweeper arm mechanism for automatic bowling alleys, in which the cycle of operation of the sweeper arm is nonlinear, and especially to permit rapid dropping of the sweeper arm, and with it the wiper blade or bar. The present invention is an improvement on the structure of the cross reference patents, the disclosure of which is incorporated herein by reference.

Subject Matter of the Present Invention

Briefly, initiation of dropping of the sweeper arm for sweeping movement is triggered by operation of an electromagnet which, in the preferred form, permits dropping of the sweeper arm under its own weight (and, for example, braked at its terminal path of travel by a dash pot) to effect rapid drop of the sweeper arm, and blade. This decreases malfunction as well as the cycling time of operation of the sweeper mechanism.

The invention will be described by way of example with reference to the accompanying drawings, in which.

Figures 1, 2:
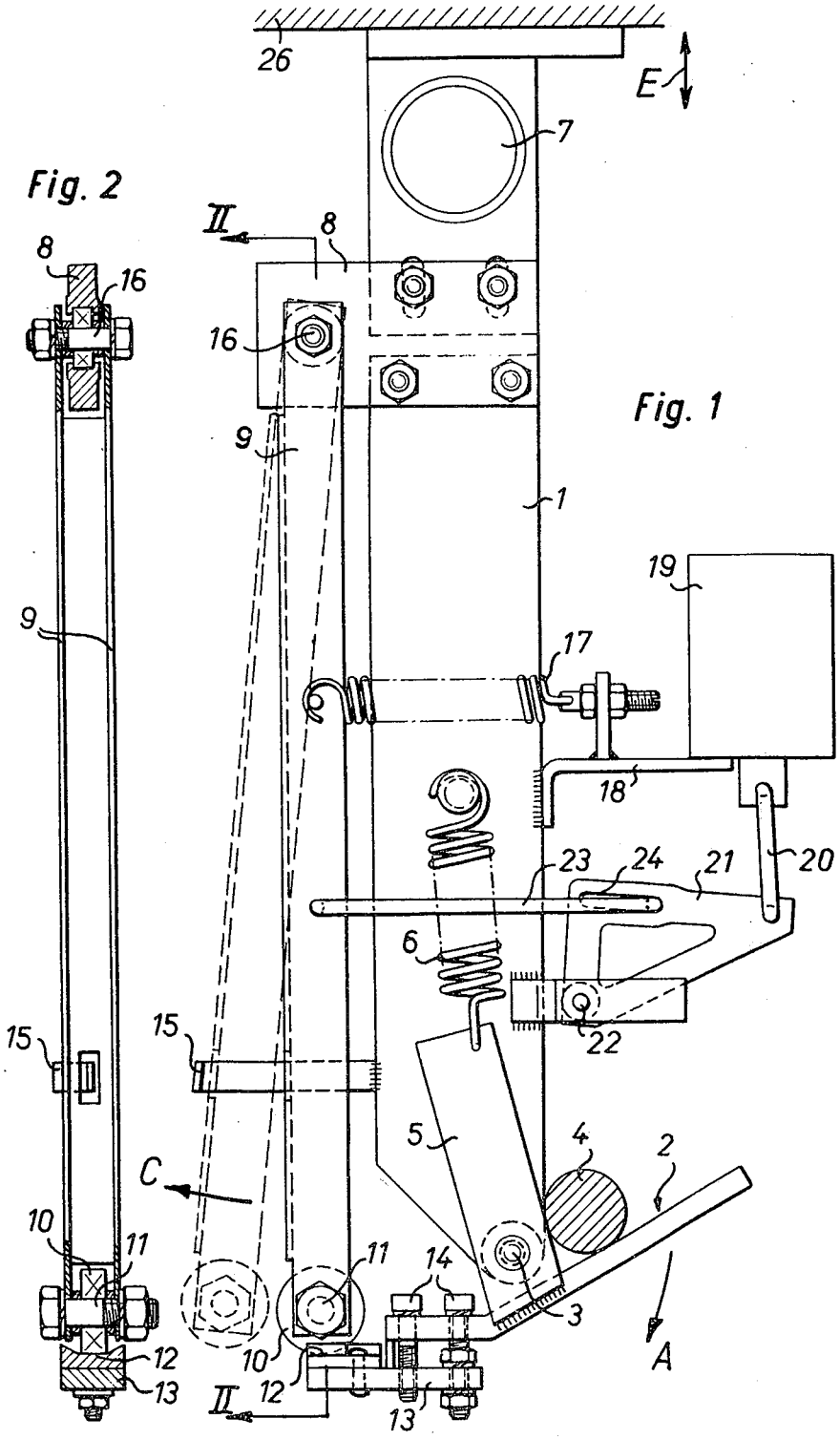
FIG. 1 is a schematic side view of the holding arrangement for a sweeper arm, generally looked at transversely from the direction of bowling of a bowling alley, the solid lines indicating the position of the mechanism when at rest and before release of the sweeper arm.
FIG. 2 is a schematic sectional view along line II—II of FIG. 1.

FIG. 3 is a vertical partly cross-sectional schematic view of the guide arrangement for the sweeper arm, looked at from the side of a bowling alley, and transversely to the direction of bowling, the solid lines illustrating the position of the sweeper arm when in dropped, released or sweeping position; and FIGS. 4*a* and 4*b* are highly schematic diagrams of a triggering system to trigger the electromagnetic release mechanism for the sweeper arm.

The entire sweeper arm cycling apparatus, as well as an illustration of the sweeper arm and its cooperation with the remainder of an automatic bowling alley, is shown in detail in the cross reference patent application of which the inventor hereof is a co-inventor, and will not be repeated. The sweeper arm, which, when in operation would sweep fallen bowling pins extends downwardly towards the floor of the bowling alley. A fragment of the arm is shown at 28. A bracket is welded thereto on which the pin 4 (FIG. 1, FIG. 3) is secured. The sweeper arm 28 can be tipped about a horizontal axis (extending at right angles to the plane of the drawing) and, additionally, it is movable in guide tracks 37 (FIG. 3) for reciprocating movement to sweep away bowling pins. A pivoted arm 1 (FIG. 1) which can swing about a horizontal axis 7 is secured to a frame 26. Frame 26 can be raised and lowered together with the bowling pin sweeping mechanism (see cross reference patent). The arm 1 carries at its lower end a hook-shaped bracket 2, pivoted about a pin 3 secured to arm 1. Hook 2 is arranged to engage, or catch the pin 4 secured to the sweeper arm 28. Hook 2 is formed with an upstanding projection 5, for example welded thereto as shown schematically in FIG. 1. The terminal end of the projecting portion 5 is connected to a tension spring 6 which biases the hook 2 into the position shown in FIG. 1. A laterally extending plate 8 is located in the vicinity of the upper end of arm 1. The release rod 9 is pivoted to plate 8 by means of a bolt 16. The rod 9, formed, for example, as a pair of linked elements (see FIG. 2) carries a roller 10 at its lower end. Roller 10, rotatable about a pin 11, forms a low-friction terminal end for the bar 9. Roller 10 bears against the projecting plate 12 which is secured to an extension holder plate 13, which, in turn, is adjustably secured by means of screws 14 to the hook 2. The extension plate 13 permits limited adjustment of the inclination of the plate 13, and hence of plate 12, so that roller 10 may run freely over plate 12. A stop element 15 is welded to arm 1, to limit the outward travel of rod 9.

A lateral bracket 18 is welded to arm 1. Bracket 18 carries an electromagnet 19 which, when energized, pulls a link 20 upwardly. Bracket 18 further carries an adjustable holder for a spring 17 (see FIG. 1). Spring 17 tends to hold the rod 9 in the full-line position shown in FIG. 1. Link 20, secured to the plunger of magnet 19, engages with an intermediate link element 21. Link element 21 is approximately triangularly shaped, pivotable about a pin 22 which, in turn, is secured by means of a bracket to arm 1. Link element 21 further is formed with an elongated slot 24, extending approximately horizontally, in which a rod 23 engages by means of a turned-over end. Rod 23 is hooked into the rod 9.

The extension plate 13, and hence plate 12, is approximately parallel to a line passing through the axis of pin 3 (FIG. 1), holding hook 2, so that the major force component holding the pin 4, and hence the sweeper arm 28 in the direction of the bar 9, is taken up by the pin 16 securing the bar 9. Only little power, therefore, is necessary to move the low-friction end formed by roller 10 of the bar in the direction of the arrow C, that is, transversely to the direction of application of the major force.

The arm 28 is rigidly secured to a connecting arm or link 41, extending at approximately right angles thereto. Rollers 39, 42 are located at the terminal ends of the link element, or arm 41. These rollers, as seen in FIG. 3, are adapted to run on a track 37, to be reciprocated in essentially horizontal direction by a suitable reciprocating drive (not shown) for sweeping movement in the direction of arrow D. Suitable drives are a crank drive, sprocket chains, (not shown) or the like, located laterally with respect to the guide tracks (37), and to sweep bowling pins located beneath the lower end (not shown) of arm 28 into a receiving pit. The extension arm 41 and the sweeper arm 28 form a stiff unit of approximately right angle with respect to each other.

An open track stub, or arm 30 (FIG. 3), pivoted on a pin 31 is secured to a dash pot assembly 32. The arm 30 is pivoted at 34 to a piston rod 35 carrying a piston operating with some clearance in a cylinder 36. Cylinder 36, in turn, is pivoted at 33 to an angle construction 43, fixed to the fixed frame of the mechanism. The arm or track stub 30 has a long angled extension 44 which, at its terminal end, has a resilient cover flap 44'. The opposite side of the guide arm 40 is rigid, as seen at 44*a*. The relative position and length of the arm 30, with respect to the position of roller 42 on arm 41, is so selected that when roller 42 moves in the direction of arrow B (FIG. 3) through a path indicated by broken lines 25, it is first supported by the rearward portion 44*a*, but free at the forward portion under the extension 44, with the end 44'. When the roller 42 has reached the guide track 37 (as seen in full line positions in FIG. 3), the forward portion 44 covers the open-end portion of the guide track 37, and reliably positions the roller 42 on the guide track 37. Guide track 37, generally, has a U-shaped cross-section, with the legs of the U being shown in section in FIG. 3; the end portion is open at the top, so that, in effect, the end portion thereof is an angle section, the U being completed when the arm 30 is in the full line position shown in FIG. 3 by the top element 44. The dash pot 32 is so arranged that the clearance between the piston and the cylinder 36 permits escape of a limited amount of gaseous, or liquid fluid from beneath the piston to the other side thereof, per unit time.

Operation:

Upon energization of electromagnet 19 (FIG. 1), link element 21 is pivoted upwardly thus pushing rod 23 to the left and, hence, moving rod 9 in the direction of the arrow C. This releases roller 10 from engagement with plate 12 secured to the extension 13 of hook 2 and the weight of the sweeper attached to sweeper arm 28, which hangs by means of pin 4 on hook 2, permits hook 2 to tip over its swing axis 3, against the restoring force of the relatively weak spring 6, thus permitting the sweeper attached to the sweeper arm 28 to drop under its own weight. The movement of the sweeper arm, and the link extension, or arm 41 is best seen in FIG. 3. In raised position, the arm 41, and with it roller 42, is shown in broken lines. Arm 30 is raised (the position of the dash pot in raised position of the arm 30 has been omitted from the drawings for clarity). Upon dropping of pin 4, and hence of arm 28, the roller 42 will move in an arc-shaped path B. The free fall of the sweeper arm 28, and the sweeper blade (not shown) attached thereto, upon movement of the hook 2 (FIG. 1) in the direction of arrow A is rapid and sudden, and thus provides for quick dropping of the sweeper arm and sweeper blade. This movement, at its terminal end, is braked by the dash pot 32, since roller 42 will be in engagement with the rear end 44*a* of arm 30. The dash pot may be pneumatic or hydraulic. When the roller 42 has reached the full line position of FIG. 3, the top plate 44, with the resilient end 44', will cover the open terminal end of the track 37, for subsequent engagement of the arm 28 by a reciprocating transport device to move the arm 28 in the direction of arrow D. Arm 28, in its movement in the direction of arrow D, is guided in tracks 37. The arm is returned after having reached the end of its path of travel by the horizontal transport mechanism. When it has reached the terminal position, it is again engaged by the hook 2, now lowered by lowering of the frame 26 (FIG. 1). The rod 9 has been restored to the full line position (since magnet 19 need be energized only momentarily to release the rod 9) by the spring 17. Upon upward movement of frame 26, engagement of pin 4 with arm 28 will tip the arm 28, so that roller 42 (FIG. 3) can engage the forward end 44 of the open-ended arm 30 and restore the roller 42, and with it arm 30 to the broken line position of FIG. 3. Movement of roller 42, through path 25, will be counter the direction of the arrow B. The arm 28 then will be at approximately right angles to the position shown in FIG. 3, and the sweeper blade, extending transversely thereto, will be removed from the bowling alley, giving free access and clear view to the bowling pins. Movement of the frame 26, in the direction of arrow E, is suitably controlled, for example, by a timing mechanism, by a sensor, or the like, controlling cycling of the automatic pin spotting apparatus by a suitably controlled motor or lift mechanism; reference is had to the aforementioned cross references.

Release of the sweeper arm due to energization of the magnet 19 is electrically controlled. Magnet 19 is momentarily energized, thus pulling in link 20. Momentary energization may be controlled manually, but preferably is controlled automatically, as illustrated in FIGS. 4*a* and 4*b*. As shown in FIG. 4*a*, a light beam gate LB is located in advance of the position of the bowling pins P. When a bowling ball BB rolls towards the pins, a beam of light extending transversely across the alley is broken, causing the light beam gate LB to provide a pause which, after suitable amplification, for example, energizes magnet 19 to retract the plunger and pull on link 20, thus releasing hook 2 and, hence, the pin 4 of the wiper arm 28 held thereby, and permitting sudden free fall, or drop thereof, braked at the end path of its travel by the operation of the dash pot 32. Since the wiper 28 will drop rapidly, and usually more rapidly than bowling pins which are flung laterally by the bowling ball, jamming of pins P beneath the wiper blade descending on the floor of the alley is reliably inhibited.

Various types of automatic triggering of the magnet 19 may be devised; besides the electro-optical triggering arrangement in FIG. 4*a*, sensing transducer V which, for example, senses vibration or shock of the alley floor, can be used to provide an electrical trigger control signal to the magnet 19. The force necessary to release the sweeper arm, derived from the electromagnet, is low since this force is only necessary to move rod 9 (FIG. 1) laterally, the relatively heavy sweeper arm dropping by its own weight. A small magnet 19 can, therefore, control a heavy sweeper arm and sweeper mechanism with high response speed.

A light beam gate to trigger magnet 19, as shown in FIG. 4*a*, is preferably located in advance of the leading pin position. If desired, a time delay (for example a capacitor, or R/C circuit) may be interposed between the signal from the gate LB and the magnet 19 to provide for suitable delay of operation of the magnet 19 with respect to response of the gate LB, and permitting locating the gate LB at a suitable position with respect to the pins 2, for example, additionally provide counting or control signals 4 gain totalizing counters, or for other control functions. Vibration transducers, or the like, would sense actual inpingement of the ball BB on the pins P, as illustrated in FIG. 4*b*, for example, or apparatus which senses changed weight distribution on the area of which the bowling pins are normally situated, is preferably located in the vicinity, or behind the leading pin position of the bowling pins setup.

Various changes and modifications may be made within the scope of the inventive concept.

I claim:

1. Bowling pin sweeper apparatus for automatic bowling alleys comprising a pin sweeper arm (28), essentially horizontal guide rails (37) guiding the arm (28) for receiprocating sweeping movement, means (26, 1, 2, 3) holding the arm (28) in raised position, said arm being lowered for subsequent movement along the guide rails, upon initiation of the sweeping cycle including a holding hook (2) pivotable about an essentially horizontal axis (3), and a vertically movable frame (26) normally in raised position with respect to the rails (37), said frame being movable to drop to a position in which the hook (2) can engage the sweeper arm (4, 28) upon termination of the sweeping cycle of the sweeper arm, and raise the sweeper arm preparatory for subsequent dropping thereof upon initiation of the next operating cycle;

electromagnet means (19) connected to the holding means (26, 1, 2, 3) which, upon energization, are operable to rapidly release the arm (28) to permit dropping by gravity and rapid lowering thereof; and two-part locking means (13, 9), one of said locking means parts (13) being connected to said hook (2) and movable therewith, the other of said locking means part (9) being operatively connected (20-24) to said electromagnetic means and operated thereby upon energization thereof to unlock said locking means and release the hook (2).

2. Apparatus according to claim 1 wherein said one locking means part (13) comprises an essentially horizontal projection (12, 13) extending from said hook (2);

said other locking means part (9) comprises a rod (9) extending at essentially right angles to the projection (13), said rod (9) being pivoted (16) to swing about an axis essentially parallel to the projection (13) upon energization of said electromagnetic means (19), and having an anti-friction end portion (10, 11) at its terminal end adjacent said projection to minimize the electromagnetic force necessary to move the rod (9) out of engagement with the projection (13).

3. Apparatus according to claim 1 wherein an extension arm (41) is secured to the sweeper arm (28) and extending therefrom at a fixed angle;

and spaced rollers (39, 42) are secured to the extension arm (41) to carry the sweeper arm in the guide rail (37) in the predetermined angle position with respect thereto.

4. Apparatus according to claim 1 further comprising light beam gate means (LB) located in advance of the foremost bowling pin position and sensing presence of a ball, said gate means providing an electrical output signal connected to the electromagnetic means (19) for energization thereof.

5. Apparatus according to claim 1 further comprising sensing switch means located on the bowling alley in the vicinity of the bowling pin positions and providing an electrical output signal to the electromagnetic means (19) to sense physical movement of the pins, or of the bowling ball on the alley.

6. Apparatus according to claim 1, wherein the sweeper arm comprises an elongated structure (28), roller means (42) secured to one end of the arm and adapted for rolling movement in the guide rails (37), said hook (4) being secured to the arm intermediate the length of the structure so that the structure comprising the arm will pivot about the roller axis of the roller means (42) when released upon energization of the electromagnet means.

7. Bowling sweeper apparatus for automatic bowling alleys comprising a pin sweeper arm (28), essentially horizontal guide rails (37) guiding the arm (28) for reciprocating sweeping movement, means (26, 1, 2, 3) holding the arm (28) in raised position, said arm being lowered for subsequent movement along the guide rails, upon initiation of the sweeping cycle;

electromagnet means (19) connected to the holding means (26, 1, 2, 3) which, upon energization, are operable to rapidly release the arm (28) to permit dropping by gravity and rapid lowering thereof;

dash pot means (32–36) engaging the arm (28) and braking the free drop of the arm (28) when the arm reaches the terminal end path of the drop and just in advance of engagement with the guide rail (37);

a roller (42) secured to the arm (28) and adapted to roll in the guide rails (37) when said sweeper arm is lowered; and a pivoted bracket (30) forming a partial guide means engaging said roller (42) when the sweeper arm is raised;

the dash pot means (32-36) being secured to the bracket (30), the relative position and length of the bracket (30) guiding the roller into the guide rails (37) upon free fall of the sweeper arm, and hence of the roller (42) as braked towards the end of the fall path by the dash pot means.

8. Apparatus according to claim 7 wherein the bracket (30) has an angled extension (44) covering the end of the guide rail (37) when the bracket is lowered after the sweeper arm (28) has dropped and the roller (42) is positioned in the guide rail (37).

9. Apparatus according to claim 7, including two-part locking means (2, 5, 13; 9), wherein said one locking means part (13) comprises an essentially horizontal projection (12, 13);

said other locking means part (9) comprises a rod (9) extending at essentially right angles to the projection (13), said rod (9) being pivoted (16) to swing about an axis essentially parallel to the projection (13) upon energization of said electro-magnetic means (19), and having an anti-friction end portion (10, 11) at its terminal end adjacent said projection to minimize the electromagnetic force necessary to move the rod (9) out of engagement with the projection (13).

10. Apparatus according to claim 7, wherein an extension arm (41) is secured to the sweeper arm (28) and extending therefrom at a fixed angle;

and spaced rollers (39, 42) are secured to the extension arm (41) to carry the sweeper arm in the guide rail (37) in the predetermined angle position with respect thereto.

11. Apparatus according to claim 7, further comprising light beam gate means (LB) located in advance of the foremost bowling pin position and sensing presence of a ball, said gate means providing an electrical output signal connected to the electromagnetic means (19) for energization thereof.

12. Apparatus according to claim 7, further comprising sensing switch means located on the bowling alley in the vicinity of the bowling pin positions and providing an electrical output signal to the electromagnetic means (19) to sense physical movement of the pins, or of the bowling ball on the alley.

13. Apparatus according to claim 7, wherein the sweeper arm comprises an elongated structure (28), the roller means (42) being secured to one end of said structure, a hook (4) being secured to the structure intermediate the lengths thereof so that the structure, comprising the arm, will pivot about the roller axis of the roller means (42) when released upon energization of the electromagnet means (19).

14. Bowling pin sweeper apparatus for automatic bowling alleys comprising a pin sweeper arm (28);

essentially horizonal, stationary guide rails (37) guiding the arm (28) for receiprocating sweeping movements;

a vertically movable frame (26) normally in raised position with respect to the rails (37);

holding means (26, 1, 2, 3) cooperating with said arm (28), said arm being lowered for subsequent movement along the guide rails (37) upon initiation of the sweeping cycle, said holding means including a holding hook (2) pivotable about a horizontal axis (3), the hook (2) having a projecting part (12, 13);

a rod (9) pivotably connected to said holding means (1, 23) to swing about a pivot axis (16) located on said holding means so that movement is essentially parallel to the projecting part (12, 13);

electromagnet means (19) secured to the holding means which, upon energization, are operable to pivot said rod (9) and thus move the projecting part out from engagement with the rod and thereby rapidly release the arm (28) by allowing the hook to pivot and to permit rapid lowering of the arm, essentially by free gravity drop;

and means (17) for biasing the rod (9) in the direction opposite to the direction of movement due to operation of the electromagnet means (19), said frame (26) being movable to drop to a position in which the hook (2) can engage the sweeper arm (28) upon termination of the sweeper arm operating cycle, raise the sweeper arm, and hold the sweeper arm on the hook (2) preparatory to subsequent dropping thereof upon initiation of the next operating cycle.

15. Apparatus according to claim 14, wherein the sweeper arm comprises an elongated structure (28), roller means (42) secured to one end of the arm and adapted for rolling movement in the guide rails (37), said hook (4) being secured to the arm intermediate the length of the structure so that the structure comprising the arm will pivot about the roller axis of the roller means (42) when released upon energization of the electromagnet means.

* * * * *